US005149908A

United States Patent [19]

Schadow et al.

[11] Patent Number: 5,149,908

[45] Date of Patent: Sep. 22, 1992

[54] COMBUSTION INSTABILITY SUPPRESSION IN REGENERATIVE LIQUID PROPELLANT GUN

[75] Inventors: Klaus C. Schadow; Ephraim Gutmark; Kenneth J. Wilson; Robert A. Smith, all of Ridgecrest, Calif.

[73] Assignee: The United States of America as represented by the Secretary of the Navy, Washington, D.C.

[21] Appl. No.: 751,362

[22] Filed: Aug. 19, 1991

Related U.S. Application Data

[63] Continuation of Ser. No. 555,881, Jul. 10, 1990, abandoned.

[51] Int. Cl.[5] ..... F41F 1/04

[52] U.S. Cl. ..... 89/7

[58] Field of Search ..... 89/7

[56] References Cited

U.S. PATENT DOCUMENTS

| | | | |
|---|---|---|---|
| 4,043,248 | 8/1977 | Bulman et al. | 89/7 |
| 4,050,348 | 9/1977 | Graham | 89/7 |
| 4,431,147 | 7/1982 | Mayer | 89/7 |
| 4,523,507 | 6/1985 | Magoon | 89/7 |
| 4,523,508 | 6/1985 | Mayer et al. | 89/7 |
| 4,586,422 | 5/1989 | Magoon | 89/7 |
| 4,838,142 | 6/1989 | Birk | 89/7 |
| 4,852,459 | 8/1989 | Bulman | 89/7 |
| 4,934,242 | 6/1990 | Bulman | 89/7 |
| 4,993,310 | 2/1991 | Sackenreuter et al. | 89/7 |

*Primary Examiner*—David H. Brown

*Attorney, Agent, or Firm*—Harvey A. Gilbert; Melvin J. Sliwka; John L. Forrest, Jr.

[57] ABSTRACT

A regenerative liquid propellant gun and pertains includes a modified conventional fixed bolt extending into a conventional combustion chamber of the regenerative liquid propellant gun. The modified fixed bolt of this invention provides for improved operation of the otherwise conventional regenerative liquid propellant gun and has modified end portion embodiments and internal propellant injection passages, all for the purpose of creating turbulent propellant flow.

8 Claims, 3 Drawing Sheets

COMBUSTION INSTABILITY SUPPRESSION IN REGENERATIVE LIQUID PROPELLANT GUN

This is a continuation of application Ser. No. 07/555,881, filed Jul. 10, 1990, now abandoned.

BACKGROUND OF THE INVENTION

The present invention relates in general to regenerative liquid propellant guns and pertains, more particularly, to a modified conventional fixed bolt extending into a conventional combustion chamber of the regenerative liquid propellant gun. The modified fixed bolt of this invention provides for improved operation of the otherwise conventional regenerative liquid propellant gun.

With the conventional regenerative liquid propellant guns it is generally accepted that gun operation can produce unwanted high frequency pressure oscillations in a combustion chamber of the regenerative liquid propellant gun. It is further known or suspected that coherent propellant vortices, the probable cause of the oscillations, are generated by propellant flow over or across a trailing end of a conventional fixed bolt. Conventional wisdom postulated an unknown driving mechanism that was believed to create these vortices.

A drawback associated with coherent propellant vortices is the known consequence of a periodic heat release that can drive further unwanted pressure oscillations. The pressure oscillations are potentially destructive to the regenerative liquid propellant gun as the pressure oscillations may cause internal gun pressures in excess of those deemed operationally safe for a particular regenerative liquid propellant gun arrangement.

It is known that different regenerative liquid propellant guns have varying operating pressures. For example, as disclosed in U.S. Pat. No. 4,043,248 for a Liquid Propellant Gun (Recoilless Regenerative Piston), issued to Bulman et al., the gun may reach a peak pressure of 20,000 psi while a conventional projectile may not move significantly forward until an intermediate pressure of about 10,000 psi has been reached within the combustion chamber.

SUMMARY OF THE INVENTION

Accordingly it is an object of the present invention to provide an improved regenerative liquid propellant gun that is adapted to suppress internal high frequency pressure oscillations. With the modified bolt of this invention it is expected that propellant turbulence introduced into a combustion chamber of the regenerative liquid propellant gun will break up the unwanted vortices.

Another object of the present invention is to provide an improved regenerative liquid propellant gun that is constructed with a modified fixed bolt resulting in a turbulent regenerative propellant flow that breaks up propellent vortices otherwise formed over a trailing edge of the conventional fixed bolt as a regenerating propellant portion flows over or across the conventional fixed bolt and into the combustion chamber.

A further object of the present invention is to provide a regenerative liquid propellant gun with a modified fixed bolt that is adapted to break up undesired vortices. The reduction or elimination of these vortices substantially avoids periodic heat release which can further drive unwanted pressure oscillations in portions of the regenerative liquid propellant gun in pressure communication with the combustion chamber.

Still another object of the present invention is to provide a regenerative liquid propellant gun fixed bolt that should be easy to employ in a practical manner and readily adaptable to existing regenerative propellant guns. The modified fixed bolt should not require any overall design change to either a conventional moveable piston arrangement or a conventional propellant formulation.

To accomplish the foregoing and other objects of this invention there is provided a modified fixed bolt for a regenerative liquid propellant gun for suppressing high frequency pressure oscillations. The modified fixed bolt comprises a modified end of the fixed bolt generally disposed in the combustion chamber portion of the regenerative liquid propellant gun.

Motion of the regenerative propellant relative to the end of the fixed bolt creates an environment in which coherent propellant vortices are created proximate a trailing edge of the fixed bolt and into the combustion chamber and the combustion zone of the chamber. The regenerative propellant moves substantially longitudinally with respect to the end of the fixed bolt and is suspected as being responsible for this trailing edge effect observed in conventional regenerative propellant guns.

The present invention relates to the trailing edge of the fixed bolt and modifications thereto, all intended to form turbulence in the regenerative propellant by breaking up the propellant flow, for example, by creating interfering axial vortices within the propellant.

In the disclosed embodiments described herein, there are illustrated a number of fixed bolt trailing end geometries. Also described are various internal propellant injection passages within the fixed bolt for injecting the regenerative propellant into the combustion chamber as alternative modifications utilized either alone or in combination with the trailing end modifications for producing the desired turbulence within the propellant entering or injected into the combustion chamber. It will be evident that the modifications will also be applicable to a slightly moveable bolt end trailing geometries.

DETAILED DESCRIPTION

Figure 1:
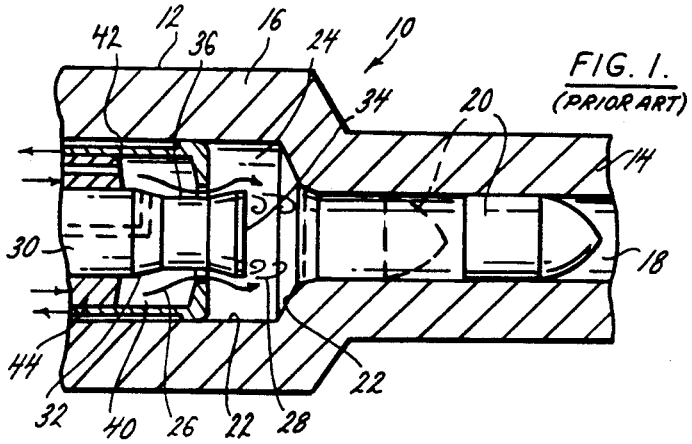
FIG. 1. (PRIOR ART)
FIG. 1 is a schematic depiction of a conventional regenerative liquid propellant gun illustrating a conventional fixed bolt and a moveable piston arrangement, a combustion chamber, bore, projectile and representation of coherent propellant vortices that the improvement of the present invention is intended to eliminate.

Referring now to the drawings there is shown in FIG. 1 a schematic for a conventional regenerative liquid propellant gun 10 to be modified in accordance with this invention. The modifications are described in accordance with a conventional fixed bolt arrangement in which regenerative propellant flows relative to the fixed piston and creates a trailing edge effect that forms unwanted coherent propellant vortices.

In a conventional fixed injection piston arrangement, the modifications disclosed herein can be incorporated relative to propellant injection ports at trailing end of the fixed piston.

The FIG. 1 drawing illustrates the schematic for the conventional regenerative liquid propellant gun 10 including a breech section 12, a barrel 14, a gun casing 16, and a conventional projectile 20 traveling through a barrel bore 18. The projectile is shown dashed in its position prior to entering the barrel bore 18. It is understood that an obturation band (shown in the dashed position) of the projectile 20 deforms as pressure in the combustion chamber increases, thereby permitting the projectile to move.

Operation of a regenerative liquid propellant gun will be further understood, for example, from U.S. Pat. No. 4,523,508 for In-line Annular Piston Fixed Bolt Regenerative Liquid Propellant Gun issued to Mayer et al., the disclosure of which is incorporated herein by reference.

An entire conventional regenerative liquid propellant gun has not been shown since the present invention relates generally to the end of the fixed bolt extending into the combustion chamber or an internal fixed bolt propellant injection passage. Reference to the Mayer et al. patent will allow those skilled in the art to be refamiliarized with the conventional regenerative propellant gun and its operation.

In FIG. 1 combustion chamber walls 22 define a combustion chamber 24 containing a conventional mono-propellant or multi-propellant mixture 26 regenerated from a propellant reservoir 40. Propellant mixture 26 flows generally longitudinally relative to a fixed bolt 30, along fixed bolt side walls 32 and over fixed bolt trailing end 34 and form the unwanted coherent propellant vortices schematically represented and identified with reference character 28.

Regenerative propellant flow in the embodiment described for purposes of illustration is provided by conventional moveable pistons 42, 44 relative to the fixed bolt 30 so as to force propellant into the combustion chamber 24 from the propellant reservoir 40. The fixed bolt 30 illustrated in FIG. 1 includes an annular contour portion 36 that provides for variable regenerative propellant flow as suggested by propellant flow lines 26 and into the combustion chamber 24.

The mechanism and process of the regenerative propellant gun is known, including the use of a variable contoured bolt to provide a desired propellant flow. The disclosures of U.S. Pat. Nos. 4,523,508 (Mayer et al.) and 4,523,507 (Magoon) are incorporated by reference for their disclosure of a regenerative liquid propellant gun with an annular piston fixed bolt. It is further known to provide a fixed bolt without the annular contour and it will be understood that an annular contoured fixed bolt is discussed herein solely for purposes of illustration. It is further known to provide a slightly moveable bolt in place of a fixed bolt.

The illustrated embodiments of the present invention will now be discussed. All possible variations can not be illustrated or described. Therefore, it will be understood that the following embodiments are not exhaustive, rather they are representative of fixed and slightly moveable bolt end effects and propellant injection passages in accordance with the present invention.

Figure 2:
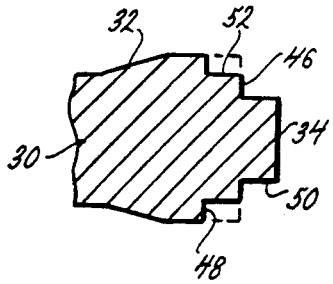
FIG. 2 depicts a cross section along a center line proximate an end of a fixed bolt modified in accordance with the present invention illustrating an embodiment of a modified trailing edge.
Figure 3:
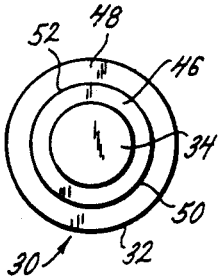
FIG. 3 depicts an end view of the embodiment illustrated in FIG. 2.

A multi-step embodiment is illustrated in FIGS. 2 and 3 and includes a single step 46 (shown dashed) or one or more steps 46, 48 (two steps are illustrated, however, additional steps may be preferred) defined by reduced diameter portions 50 and 52 of the bolt side wall 32 of the fixed bolt 30. The trailing end turbulence effect modification is proximate the fixed bolt trailing end 34 for this and the other embodiments of the present invention, whether of not specifically identified as such in the disclosure.

Figure 4:
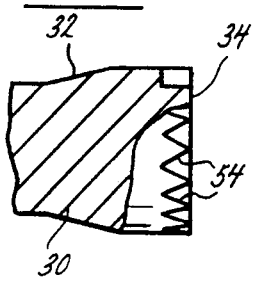
FIG. 4 depicts a cross section along a center line proximate an end of a fixed bolt modified in accordance with the present invention illustrating another embodiment of a modified trailing edge.
Figure 5:
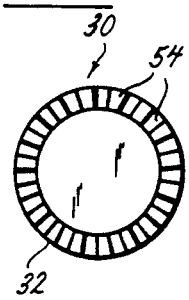
FIG. 5 depicts an end view of the embodiment illustrated in FIG. 4.

A corrugated trailing end is illustrated in FIGS. 4 and 5 and includes a plurality of corrugations 54 defined by the fixed bolt trailing end 34 of the fixed bolt 30. In another preferred embodiment multi-directional corrugations (not shown) may be provided, as well.

Figure 6:
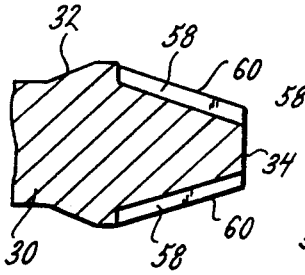
FIG. 6 depicts a cross section along a center line proximate an end of a fixed bolt modified in accordance with the present invention illustrating another embodiment of a modified trailing edge.
Figure 7:
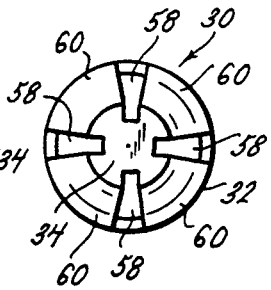
FIG. 7 depicts an end view of the embodiment illustrated in FIG. 6.

A tapered, grooved, truncated cone is illustrated in FIGS. 6 and 7 and includes a plurality of grooves 58 defined by tapered side walls 60 of the fixed bolt 30. Four grooves 58 are depicted in the drawings. As depicted in the end view, the grooves 58 extend beyond the tapered side walls 60 and into the fixed bolt trailing end 34 of the fixed bolt 30.

Other combinations of grooves may be used with the understanding that (in this and the other embodiments of the present invention) the grooves, or other modified end effect structure of the fixed bolt 30 should provide for balanced regenerative propellant flow with respect to the fixed bolt. Thus, three grooves (not shown) may be used, preferably separated 120° apart around the longitudinal axis of the fixed bolt 30.

Figure 8:
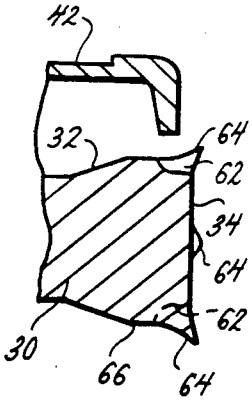
FIG. 8 depicts a cross section along a center line proximate an end of a fixed bolt modified in accordance with the present invention illustrating another embodiment of a modified trailing edge.
Figure 9:
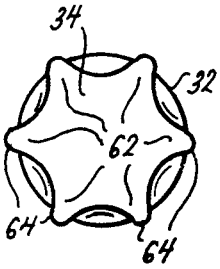
FIG. 9 depicts an end view of the embodiment illustrated in FIG. 8 rotated approximately 30° for clarity.

A lobe ended fixed bolt is illustrated in FIGS. 8 and 9 and includes the fixed bolt 30 with the fixed bolt trailing end 34 and fixed bolt side walls 32 defining a plurality of lobes 62. The lobes 62 extend generally out and away from the fixed bolt trailing end 34 and include a plurality of protruding portions 64.

Another side wall portion 66 has a reduced diameter, if necessary, in order to allow clearance between the moveable piston portion 42 (shown on one side only in FIG. 8 and without the other moveable piston 44 of the conventional assembly) and the protruding portions 64 of the lobes 62 defined by the fixed bolt 30.

Figure 10:
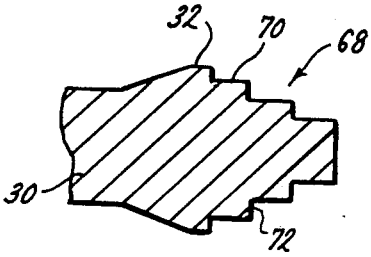
FIG. 10 depicts a cross section along a center line proximate an end of a fixed bolt modified in accordance with the present invention illustrating another embodiment of a modified trailing edge.
Figure 11:
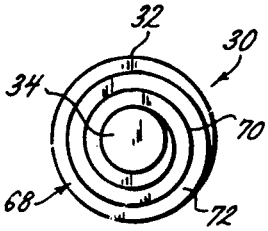
FIG. 11 depicts an end view of the embodiment illustrated in FIG. 10.

A tapering spiral groove embodiment of the fixed bolt of the present invention is illustrated in FIGS. 10, 11 and includes a fixed bolt 30 having the fixed bolt side wall portion 32 and the fixed bolt trailing end 34 defining a tapering spiral groove 68. The tapering spiral groove 68 includes a spiral wall portion 70 and a ramped surface 72.

Figure 12A:
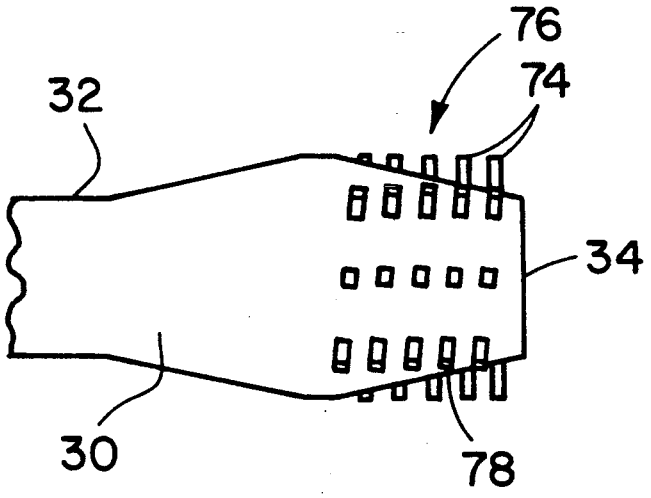
FIG. 12*a* depicts a top plan view of the embodiment shown in FIG. 12.
Figure 12:
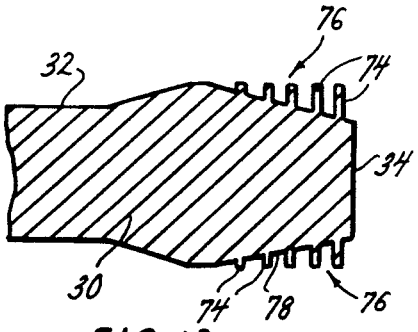
FIG. 12 depicts a cross section along a center line proximate an end of a fixed bolt modified in accordance with the present invention illustrating another embodiment of a modified trailing edge.
Figure 13:
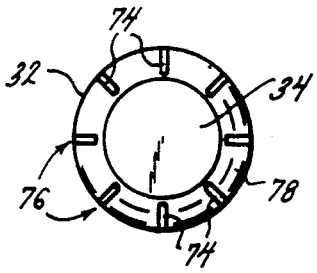
FIG. 13 depicts an end view of the embodiment illustrated in FIG. 12.

A plurality of extending pins on a tapered surface is illustrated in FIGS. 12 and 13 and includes a plurality of pins 74 arranged in a plurality of rows 76 generally parallel to the longitudinal axis of the fixed bolt 30. The pins 74 extend outward from a tapered surface 78 that decreases in diameter as it approaches the fixed bolt trailing end 34 of the fixed bolt 30. The lengths of the pins generally increase the closer they are located to the fixed bolt trailing end 34.

In FIGS. 12 and 13 of the illustrated embodiment the combined length of the pin and radius of the tapered surface proximate the pin is generally equal to the maximum radius of the fixed bolt side walls 32. While the pins in the illustrated embodiment are arranged in generally straight longitudinal rows it will be understood that spiral rows (not shown) can accomplish the same effect. The pins may also vary in length, for example in a random fashion (not shown) in order to increase the turbulence of the flowing regenerative propellant 26.

An embodiment of the fixed bolt 30 combining the modified fixed bolt end portion 34 and an axial regenerative propellant injection passage 80 is illustrated in FIGS. 14 through 19. These embodiments of the present invention generally refer to a regenerative liquid propellant gun 10 in which a portion of the regenerative propellant 26 is introduced through the fixed bolt 30 and generally out of the fixed bolt trailing end 34.

It will be understood by one skilled in the art the manner in which regenerative propellant 26 is communicated to the internal passage 80 from the propellant reservoir 40. At least one of the references incorporated herein by reference, for example, describe at least one manner for communicating the regenerative propellant 26 from the reservoir 40 to the passage 80.

The injection of the regenerative propellant 26 through passage 80 is intended to enhance propellant turbulence as it enters the combustion chamber 24.

Figure 14:
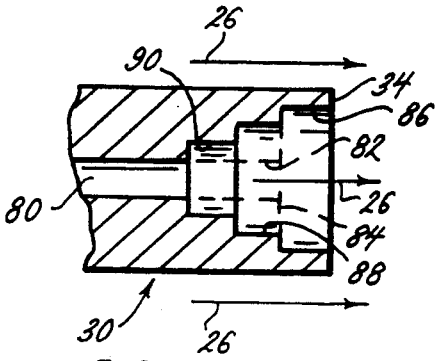
FIG. 14 depicts a cross section along a center line proximate an end of a fixed bolt modified in accordance with the present invention illustrating an embodiment of a combination modified trailing edge and longitudinal propellant passage.
Figure 15:
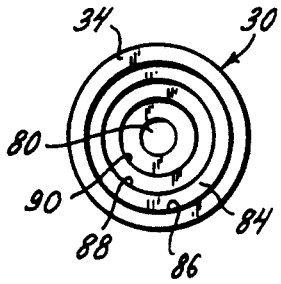
FIG. 15 depicts an end view of the embodiment illustrated in FIG. 14.

An embodiment incorporating an internal step arrangement is illustrated in FIGS. 14 and 15 and includes a single step embodiment (shown dashed) and a multiple step embodiment. The single step embodiment includes a passage wall 82 that is enlarged to define a counter sunk surface 84 providing an enlarged passage wall portion 86 proximate the fixed bolt trailing end 34 of the fixed piston 30.

The multiple step arrangement includes the desired number of passage wall step outs 88, 90 (two shown) and any desired number of step outs will provide an equivalent arrangement.

Figure 16:
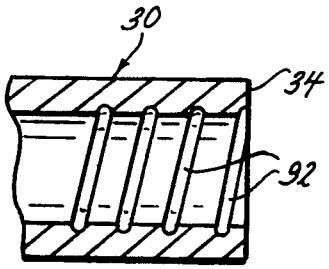
FIG. 16 depicts a cross section along a center line proximate an end of a fixed bolt modified in accordance with the present invention illustrating another embodiment of a combination modified trailing edge and longitudinal propellant passage.
Figure 17:
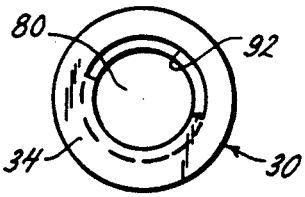
FIG. 17 depicts an end view of the embodiment illustrated in FIG. 16.

An embodiment incorporating an internal swirl arrangement is illustrated in FIGS. 16 and 17 and include the fixed bolt 30 having the internal passage 80 as previously discussed and the incorporation of an internal groove pattern 92 defined by the passage wall 82. The grooves tend the regenerative propellant to exit the passage 80 in a swirl pattern, thereby creating the desired turbulence or interfering propellant vortices within the combustion chamber 24.

Figure 18:
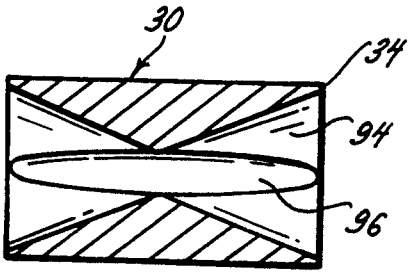
FIG. 18 depicts a cross section along a center line proximate an end of a fixed bolt modified in accordance with the present invention illustrating another embodiment of a combination modified trailing edge and longitudinal propellant passage.
Figure 19:
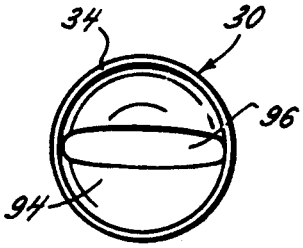
FIG. 19 depicts an end view of the embodiment illustrated in FIG. 18.

The final embodiment illustrated and described is depicted in FIGS. 18 and 19 and includes a compound passage 94 defining an internally tapered elliptical orifice 96. The embodiment provides a nozzle for further providing for turbulent regenerative propellant flow into the combustion chamber 24.

In operation, each of the effects depicted and described herein or their equivalents create turbulent flow in regenerative propellant 26 as it flows across or over the fixed bolt trailing end 34 of the fixed bolt 30. In operation it is believed that significant three dimensional flow is provided by the fixed bolt trailing end 34 modifications described herein and their equivalents so as to induce the turbulent flow and inhibit creation of any coherent propellant vortices 28.

Axial grooves, for example, should generate an enhanced turbulent flow and produce axial or stream-wise vortices in the regenerative propellant 26 as it enters the combustion chamber 24.

Turbulent flow is by its nature random. The randomness of the regenerative propellant 26 flow over the modified fixed bolt trailing end 34 of the fixed bolt 30 tends to break up any coherent propellant vortices 28 formed in the combustion chamber 24 and inhibit the formation of coherent propellant vortices 28.

The turbulence forms axial vortices (e.g., the lobed embodiment) and transverse vortices (e.g., the spiral grooved or internal grooved embodiments) that establish interfering vortices further providing for the break up of any coherent propellant vortices formed and inhibit the formation of coherent propellant vortices.

The operation of a conventional regenerative liquid propellant gun providing for an internal passage in a fixed bolt or other equivalent projection of this type will be understood, for example, from U.S. Pat. No. 4,523,508 in which passages opening into the propellant reservoir allow regenerative propellant flow through the internal passage in the fixed bolt.

From the foregoing description those skilled in the art will appreciate that all of the objects of the present invention are realized. An improved regenerative liquid propellant gun has been shown and described for providing a desired turbulence in a regenerative propellant flow through modifications to the fixed bolt of the otherwise conventional gun arrangement.

The modified fixed bolt is adapted to suppress internal high frequency pressure oscillations. Propellant turbulence introduced into a combustion chamber of the regenerative liquid propellant gun will break up the unwanted vortices.

An improved regenerative liquid propellant gun is constructed with a modified fixed bolt resulting in a turbulent regenerative propellant flow that breaks up propellent vortices otherwise formed over a trailing edge of a conventional fixed bolt as a regenerating propellant portion flows over or across the conventional fixed bolt and into the combustion chamber.

A regenerative liquid propellant gun has a modified fixed bolt adapted to break up undesired vortices such that the reduction or elimination of these vortices substantially avoids periodic heat release which can further drive unwanted pressure oscillations in portions of the regenerative liquid propellant gun in pressure communication with the combustion chamber.

An improved regenerative liquid propellant gun fixed bolt is provide that is easy to employ in a practical manner and readily adaptable to existing regenerative propellant guns without requiring any overall design change to either a conventional moveable piston arrangement or a conventional propellant formulation.

While specific embodiments have been shown and described it will be readily apparent that many variations are possible to obtain the desired surface effect of a fixed or slightly moveable bolt, either externally or internally, with respect to the internal regenerative propellant injection passage.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A fixed bolt in a regenerative liquid propellant gun being centrally disposed within and spaced apart from the surrounding walls of a breach containing a combustion chamber and a reservoir adapted to contain a regenerative liquid propellant, said fixed bolt comprising:

an elongated generally cylindrical body having a central longitudinal axis;

a leading end portion fixedly supported by said breech; and a variable geometry trailing free end proximate the reservoir and juxtapositioned the combustion chamber, said trailing free end symmetrical about the longitudinal axis on the outside surface of said trailing end and comprising a reduced fixed bolt outside diameter portion defining a step in the fixed bolt.

2. A fixed bolt in a regenerative liquid propellant gun being centrally disposed within and spaced apart from the surrounding walls of a breech, the breech containing a combustion chamber and a reservoir adapted to contain a regenerative liquid propellant flow, the fixed bolt comprising:

an elongated generally cylindrical body having a central longitudinal axis;

a leading end portion fixedly supported by the breech; and trailing free end of variable geometry comprising a plurality of protrusions extending longitudinally of said bolt into said flow, symmetrical about the central longitudinal axis of said bolt, proximate the reservoir, and juxtapositioned the combustion chamber, said trailing free end of variable geometry is further disposed so that the trailing free end of variable geometry communicates with the liquid propellant flow and produces an effective amount and orientation of a turbulent regenerative propellant flow about the trailing free end to eliminate or inhibit the formation of coherent propellant vortices within the combustion chamber of the regenerative propellant gun.

3. A fixed bolt as set forth in claim 2, wherein the trailing free end or variable geometry having the plurality of protrusions extending longitudinally into said flow further comprises a plurality of reduced fixed bolt diameter portions.

4. A fixed bolt as set forth in claim 3, wherein the reduced fixed bolt diameter portion further defines an annular step.

5. A fixed bolt in a regenerative liquid propellant gun being centrally disposed within and spaced apart from the surrounding walls of a breech, the breech containing a combustion chamber and a reservoir adapted to contain a regenerative liquid propellant flow, the fixed bolt comprising:

an elongated generally cylindrical body having a central longitudinal axis, a leading end portion fixedly supported by the breech, and a trailing free end proximate the reservoir and juxtapositioned the combustion chamber; and a variable geometry longitudinally protruding means symmetrical about the central longitudinal axis of said bolt, disposed at said trailing free end so that an effective amount and orientation of turbulent regenerative propellant flow is established about the trailing free end to eliminate or inhibit the formation of coherent propellant vortices within the combustion chamber of the regenerative propellant gun.

6. A fixed bolt as set forth in claim 5, wherein the variable geometry longitudinally protruding means is disposed on the outside surface of the bolt.

7. A fixed bolt as set forth in claim 5, wherein the variable geometry longitudinally protruding means comprises a reduced fixed bolt diameter portion.

8. A fixed bolt as set forth in claim 7, wherein the variable geometry longitudinally protruding means further defines an annular step.

* * * * *